US007364018B2

(12) United States Patent
Pascoe et al.

(10) Patent No.: US 7,364,018 B2
(45) Date of Patent: Apr. 29, 2008

(54) OIL PUMP DRIVE ASSEMBLY

(75) Inventors: David Mark Pascoe, Newmarket (CA); Richard D. Muizelaar, Mississauga (CA)

(73) Assignee: Tesma International Inc., Concord, Ontario (CA)

( * ) Notice: Subject to any disclaimer, the term of this patent is extended or adjusted under 35 U.S.C. 154(b) by 438 days.

(21) Appl. No.: 10/768,506

(22) Filed: Jan. 30, 2004

(65) Prior Publication Data

US 2004/0216956 A1 Nov. 4, 2004

Related U.S. Application Data

(60) Provisional application No. 60/444,055, filed on Jan. 31, 2003.

(51) Int. Cl.
*F16N 7/14* (2006.01)
*F16N 7/36* (2006.01)
*F16N 13/10* (2006.01)

(52) U.S. Cl. ..... 184/27.1; 184/6.28

(58) Field of Classification Search ..... 184/2–27.4, 184/28–36, 6.28; 123/196 R, 192.2
See application file for complete search history.

(56) References Cited

U.S. PATENT DOCUMENTS

| | | | | |
|---|---|---|---|---|
| 2,914,137 | A * | 11/1959 | Sykes, Jr. | 184/48.1 |
| 4,373,483 | A | 2/1983 | Bury | |
| 5,535,643 | A | 7/1996 | Garza | |
| 6,116,878 | A | 9/2000 | Miura | |
| 6,183,230 | B1 * | 2/2001 | Beardmore et al. | 418/171 |
| 6,267,094 | B1 | 7/2001 | Kuettner et al. | |
| 6,601,557 | B1 * | 8/2003 | Hayman et al. | 123/192.2 |
| 2001/0023623 | A1 * | 9/2001 | Killion | 74/603 |

* cited by examiner

*Primary Examiner*—Richard Ridley
*Assistant Examiner*—James Pilkington
(74) *Attorney, Agent, or Firm*—Clark Hill PLC

(57) ABSTRACT

An oil pump drive assembly for an automobile engine includes an oil pump and a drive shaft. The drive shaft is rotatably secured to the oil pump for actuating the oil pump in response to rotation of the drive shaft. The drive shaft extends between a pump end secured to the oil pump and a distal end. A sprocket is secured to the distal end of the drive shaft. A drive gear is secured to the drive shaft between the pump end and the distal end. A driven gear is engaged with the drive gear for rotation of the driven gear in response to rotation of the drive shaft. A balance shaft extends axially from the driven gear for rotation with the driven gear in response to rotation of the drive shaft for dampening vibrations associated with the operation of the automobile engine.

4 Claims, 2 Drawing Sheets

OIL PUMP DRIVE ASSEMBLY

RELATED APPLICATION

This application claims priority to and all the benefits of U.S. provisional application 60/444,055, filed Jan. 31, 2003.

BACKGROUND OF THE INVENTION

1. Field of the Invention

The invention relates to an oil pump drive assembly for an automobile engine. More particularly, the invention relates to a balance shaft driven by a rotating drive shaft of an oil pump.

2. Description of the Related Art

Automobile engines include an oil pump for pumping oil to lubricate moving parts within the engine. Engines typically include a rotating balance shaft for dampening vibrations associated with the operation of the engine. Preferably, the balance shaft rotates at generally twice the speed of the engine. The higher rotational speed of the balance shaft is typically achieved by the use of a gear assembly coupled between the engine and the balance shaft.

It is known to drive the oil pump with the rotation of the balance shaft. Since the oil pump operates at approximately the same speed as the engine, the lower operational speed of the pump relative to the balance shaft is achieved by the use of a second gear assembly coupled between the balance shaft and the oil pump. Multiple sets of gears at each end of the balance shaft increase the costs of manufacture and inventory.

SUMMARY OF THE INVENTION

According to one aspect of the invention, an oil pump drive assembly for an automobile engine is provided. The oil pump drive assembly includes an oil pump. A drive shaft is rotatably secured to the oil pump for actuating the oil pump in response to rotation of the drive shaft. The drive shaft extends between a pump end secured to the oil pump and a distal end. A sprocket is secured to the distal end of the drive shaft. A gear assembly including a drive gear secured to the drive shaft between the pump end and the distal end and a driven gear engaged with the drive gear for rotation of the driven gear in response to rotation of the drive shaft is provided. The gear assembly is positioned at the distal input end of the drive shaft and the oil pump is positioned at an opposite pump end of the drive shaft for providing packaging space for the oil pump drive assembly.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1A:
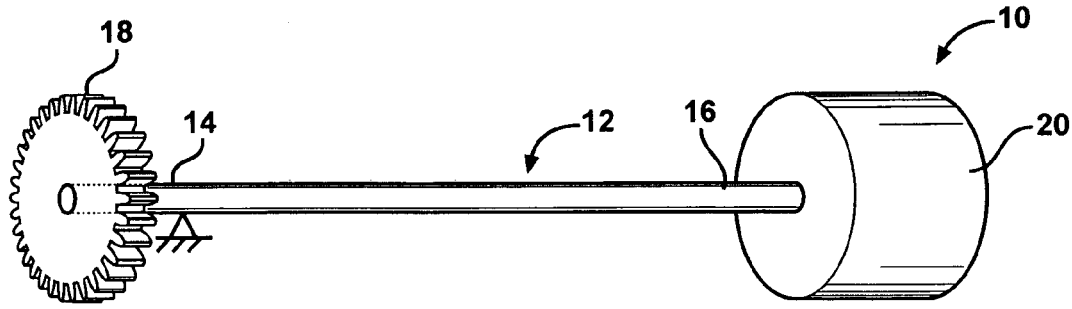
FIG. 1A is a schematic view of the oil pump drive assembly without a balance shaft.
Figure 3:
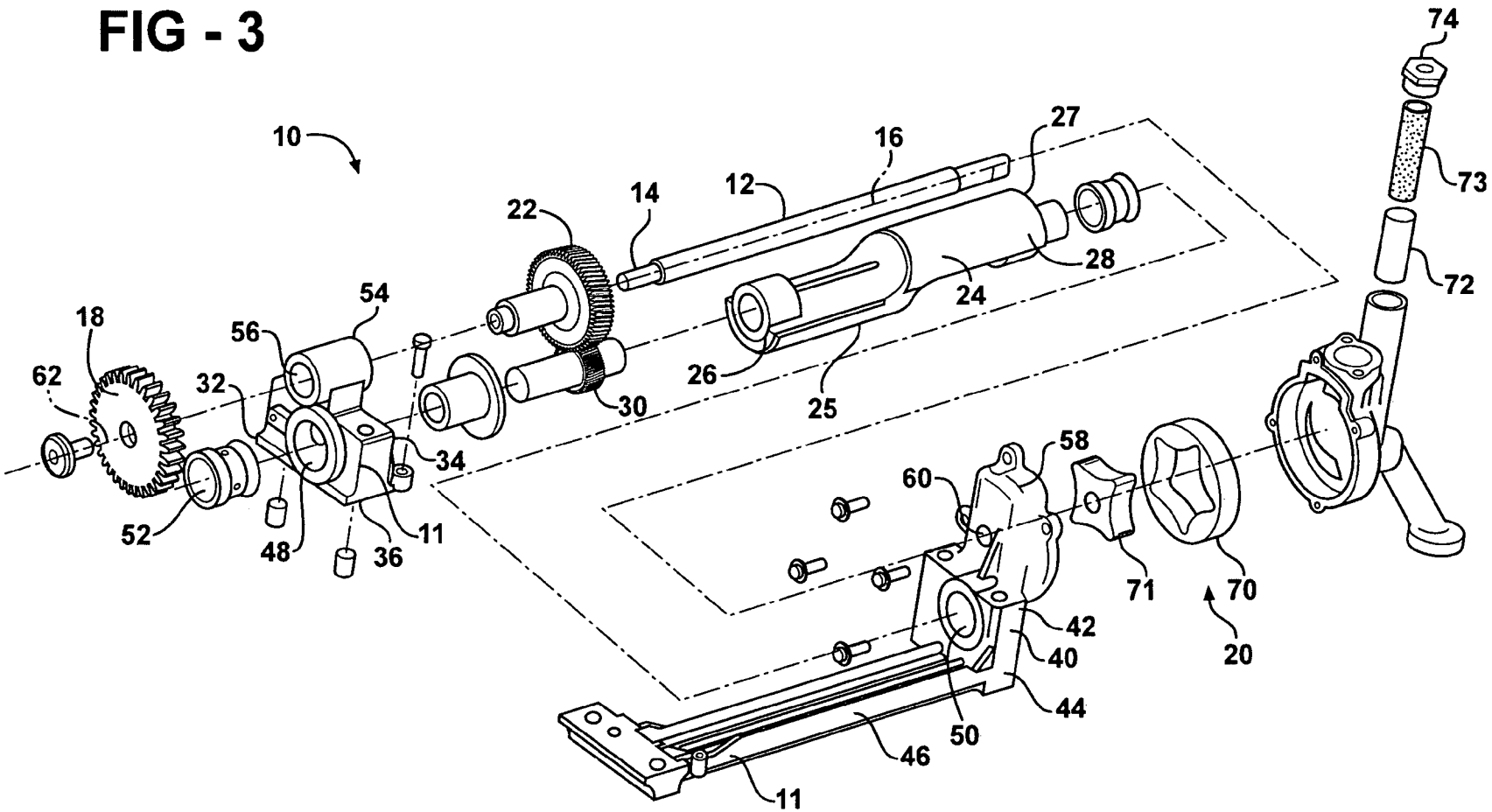
FIG. 3 is an exploded perspective view of the oil pump drive assembly with a balance shaft.

Referring to FIGS. 1 and 3, an oil pump drive assembly for an automotive engine is generally indicated at 10. The oil pump drive assembly 10 includes a housing 11. A drive shaft 12 extending between a sprocket end 14 and a pump end 16 is journaled to the housing 11. A sprocket gear 18 is fixedly secured to the sprocket end 14 of the drive shaft 12. The sprocket gear 18 is rotatably driven by an engine driven chain, belt and the like to cause rotation of the drive shaft 12. A pump 20 is coupled to the pump end 16 of the drive shaft 12 for actuating the pump 20 in response to rotation of the drive shaft 12. In a first embodiment of the invention shown in FIG. 1A, the oil pump drive assembly 10 does not include a balance shaft, as will be discussed in more detail below with reference to a second embodiment. As can be seen, the pump 20 is positioned at a rear or distal end of the drive shaft 12 to allow for packaging space for the oil pump 20 in a congested engine compartment of a vehicle. Preferably, the pump 20 comprises a gerotor type pump having a pump stator 70, pump gerotor 71, pump valve body 72, pump valve spring 73, and pump valve plug 74 disposed within a pump housing 58, as best seen in FIG. 3.

Figure 1B:
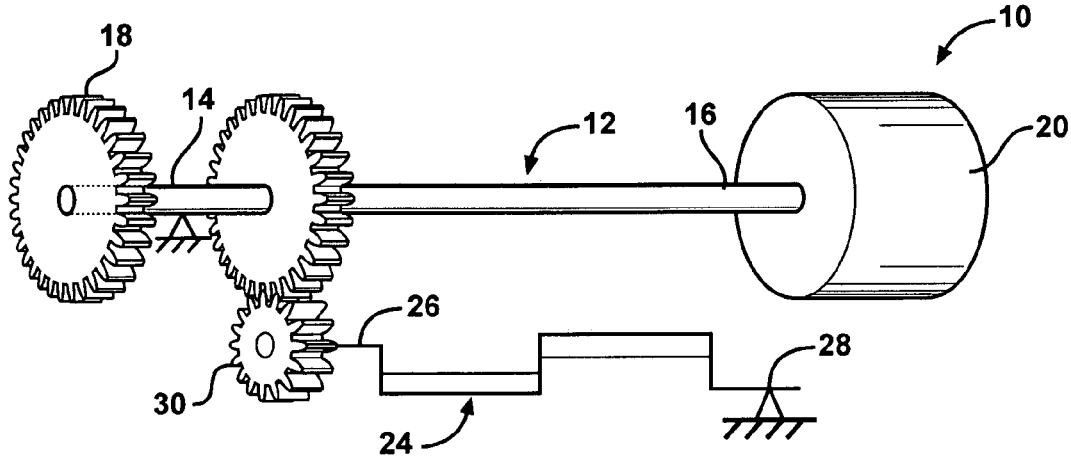
FIG. 1B is a schematic view of the oil pump drive assembly with a balance shaft.

A second embodiment of the oil pump drive assembly 10 of the present invention is shown in FIGS. 1B and 3. A drive gear 22 is fixedly secured to the drive shaft 12 between the sprocket end 14 and the pump end 16. The drive gear 22 rotates with the drive shaft 12.

A balance shaft 24, generally parallel to the drive shaft 12, extends between a gear end 26 and a distal end 28. The balance shaft 24 is journaled to the housing 11. A driven gear 30 is fixedly secured to the gear end 26 of the balance shaft 24. The driven gear 30 is engaged with the drive gear 22 to cause rotation of the balance shaft 24 in response to rotation of the drive shaft 12. Preferably, the driven gear 30 has a smaller diameter than that of the drive gear 22 so that the balance shaft 24 rotates at a higher speed than the drive shaft 12.

The housing 11 includes a sprocket side 32 and a pump side 40. The sprocket side 32 extends between an upper end 34 and a lower end 36. The pump side 40 extends between an upper end 42 and a lower end 44. A base 46 extends between the lower ends 36, 44 of the sprocket 32 and pump 40 sides, respectively. A first bore 48 is formed in the sprocket side 32 for supporting the gear end 26 of the balance shaft 24 therethrough. A second bore 50 is formed in the pump side 34 for supporting the distal end 28 of the balance shaft 24 therethrough. The first 48 and second 50 bores define a first axis 52. The balance shaft 24 rotates about the first axis 52.

A balance shaft 24, generally parallel to the drive shaft 12, extends between a gear end 26 and a distal end 28. The balance shaft 24 is journaled to the housing 11. The balance shaft 24 includes at least two axially spaced offset masses 25, 27. A driven gear 30 is fixedly secured to the gear end 26 of the balance shaft 24. The driven gear 30 is engaged with the drive gear 22 to cause rotation of the balance shaft 24 in response to rotation of the drive shaft 12. Preferably, the driven gear 30 has a smaller diameter than that of the drive gear 22 so that the balance shaft 24 rotates at a higher speed than the drive shaft 12.

The housing 11 includes a sprocket side 32 and a pump side 40. The sprocket side 32 extends between an upper end 34 and a lower end 36. The pump side 40 extends between an upper end 42 and a lower end 44. A base 46 extends between the lower ends 36, 44 of the sprocket 32 and pump 40 sides, respectively. A first bore 48 is formed in the sprocket side 32 for supporting the gear end 26 of the balance shaft 24 therethrough. A second bore 50 is formed in the pump side 40 for supporting the distal end 28 of the balance shaft 24 therethrough. The first 48 and second 50 bores define a first axis 52. The balance shaft 24 rotates about the first axis 52.

A tube 54 is secured to the upper end 34 of the sprocket side 32 of the housing 11. A cylindrical third bore 56 is defined by the tube 54 for supporting the sprocket end 14 of the drive shaft 12. The pump housing 58 is secured to the upper end 42 of the pump side 40 of the housing 11. A fourth bore 60 is formed in the pump housing 58 for supporting the pump end 16 of the drive shaft 12. The third 56 and fourth 60 bores define a second axis 62. The drive shaft 12 rotates about the second axis 62. The pump 20 is enclosed in the pump housing 58 which is attached to the housing 11.

In operation, the sprocket 130 is rotatably driven by the engine. The drive gear 122 rotates with the sprocket 130, which causes rotation of the driven gear 118. The balance shaft 112 and the rear drive gear 120 rotate together with the driven gear 118. The rear driven gear 132, driven by the rear drive gear 120, rotates in response to the rotation of the balance shaft 112. The pump 140 is driven by the rotation of the rear driven gear 132.

Figure 2:
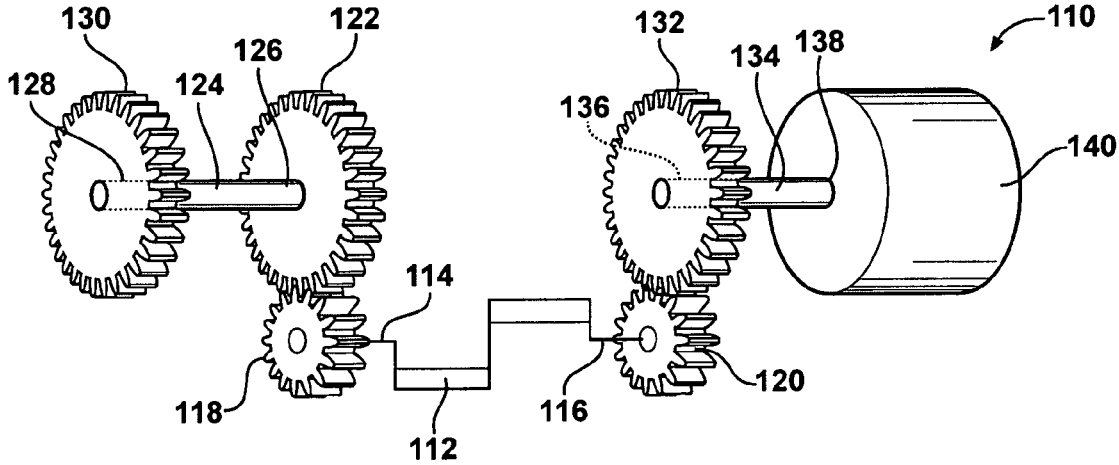
FIG - 2 Prior Art
FIG. 2 is a schematic view of a conventional oil pump drive assembly.

For comparative purposes, a conventional oil pump drive assembly for an automobile engine is generally indicated at 110 in FIG. 2. The conventional oil pump drive assembly 110 includes a balance shaft 112 extending longitudinally between an input end 114 and an output end 116. A driven gear 118 is secured to the input end 114. A rear drive gear 120 is secured to the output end 116. A drive gear 122 is engaged with the driven gear 118 for rotating the driven gear 118 and the balance shaft 112 in response to rotation of the drive gear 122. A first shaft 124 extends axially between a drive gear end 126 secured to the drive gear 122 and a sprocket end 128. A sprocket 130 is fixedly secured to the sprocket end 128 of the first shaft 124. A rear driven gear 132 is engaged with the rear drive gear 120 for rotation of the rear driven gear 132 in response to rotation of the balance shaft 112. A second shaft 134 extends axially between a driven gear end 136 secured to the rear driven gear 132 and a pump end 138. A pump 140 is coupled to the pump end 138 of the second shaft 134 for actuation of the pump 140 in response to rotation of the rear driven gear 132.

The invention has been described in an illustrative manner, and it is to be understood that the terminology, which has been used, is intended to be in the nature of words of description rather than of limitation.

Many modification and variations of the present invention are possible in light of the above teachings. It is, therefore, to be understood that within the scope of the appended claims, the invention may be practiced other than as specifically described.

What is claimed is:

1. An oil pump drive assembly for an automobile engine; said oil pump drive assembly consisting of:

a housing having a sprocket side and a pump side, the sprocket side including a first bore and a third bore and the pump side including a second bore and a fourth bore;

an oil pump;

a drive shaft disposed in the housing and extending axially between a distal input end supported in the third bore on the sprocket side of the housing and an opposite pump end supported in the fourth bore on the pump side of the housing, the opposite pump end secured to the oil pump for actuating the oil pump in response to rotation of the drive shaft;

a sprocket secured to the distal input end of the drive shaft;

a gear assembly for transferring a force from the engine comprising a drive gear secured to the drive shaft between the pump and the distal input end and a driven gear engaged with the drive gear for rotation of the driven gear in response to rotation of the drive shaft; and a balance shaft disposed in the housing and extending axially between a gear end supported in the first bore on the sprocket side of the housing and an opposite distal end supported in the second bore on the pump side of the housing, the gear end secured to the driven gear for rotation with the driven gear in response to rotation of the drive shaft for dampening vibrations associated with the operation of the automobile engine, and the balance shaft supporting two axially spaced offset masses;

the gear assembly positioned at the distal input end of the drive shaft and the oil pump positioned at the opposite pump end of the drive shaft for providing packaging space for the oil pump drive assembly.

2. The oil pump drive assembly of claim 1 wherein the driven gear has a smaller diameter than the drive gear for providing a different rotation speed for the balance shaft.

3. The oil pump drive assembly of claim 2 wherein the balance shaft rotates at twice the speed of the drive shaft.

4. The oil pump drive assembly of claim 1 wherein the oil pump operates at the same rotational speed as the engine for increasing the oil pump efficiency and durability and to reduce noise of the oil pump.

* * * * *